United States Patent [19]

Rhoades

[11] Patent Number: 4,996,796

[45] Date of Patent: Mar. 5, 1991

[54] PROCESS AND APPARATUS OF ABRADING BY EXTRUSION

[75] Inventor: Lawrence J. Rhoades, Pittsburgh, Pa.

[73] Assignee: Extrude Hone Corporation, Irwin, Pa.

[21] Appl. No.: 134,116

[22] Filed: Dec. 17, 1987

[51] Int. Cl.[5] ..... B24B 31/00

[52] U.S. Cl. ..... 51/26; 51/2 R; 51/318

[58] Field of Search ..... 51/318, 317, 2 R, 7, 51/16, 17, 26

[56] References Cited

U.S. PATENT DOCUMENTS 3,728,821 4/1973 Perry ..... 51/2 R 3,802,128 4/1974 Minear, Jr. et al. ..... 51/2 R

FOREIGN PATENT DOCUMENTS 0156661 9/1984 Japan ..... 51/7

*Primary Examiner*—Robert A. Rose

*Attorney, Agent, or Firm*—Waldron & Associates

[57] ABSTRACT

An apparatus for abrading a workpiece surface by extruding a flowable plastic abrading medium through a passageway which includes said workpiece surface. The apparatus utilizes at least three chambers for feeding and receiving said medium whereby at least two of said chambers operate at differential parameters to effect differential abrasion on different surfaces of said workpiece.

18 Claims, 2 Drawing Sheets

PROCESS AND APPARATUS OF ABRADING BY EXTRUSION

This invention relates to improvements in the techniques of abrading by extrusion. More specifically, this invention relates to improvements in the method and apparatus for the abrading of selected surfaces on workpieces by the extrusion of a viscous plastic material, permeated with a finely divided abrasive grit, through or past the workpiece surface to affect the abrading action. The inventive concept utilizes at least three ports of ingress and egress of the plastic material so that extrusion parameters can be selectively controlled at the various ports to vary the degree and nature of abrasion through a plurality of intersecting passageways.

As machines and engines become more complex and sophisticated, the designs of various machine and engine components are naturally becoming more complicated with more complex and exacting machining and finishing requirements. Some internal surfaces, for example, may be very difficult to reach for machining or grinding by conventional means. Other surfaces, such as intersecting bores, slots and splines, which can readily be machined, invariably leave sharp corners or raised burrs at surface intersections after machining which cannot readily be honed by conventional techniques. The process of abrading by extrusion, or abrasive flow machining, is particularly useful where such conditions exist on a workpiece which cannot be readily finished by the more conventional means of grinding, lapping or honing. The abrasion action in abrasive flow machining can be thought of as analogous to a filing, grinding, lapping or honing operation where the extruded medium passes through or past the workpiece as a "plug". The plug then becomes a self forming file, grinding stone or lap as it extrudes under pressure through the passages restricting its flow, thereby working, i.e. abrading, the selected surfaces of the workpiece.

While abrasive flow machining is somewhat similar to other abrasion techniques wherein fluids are used as a medium to carry an abrasive grit in suspension for similar abrasion treatments, there are considerable differences. In applications where fluids are used, i.e. liquids or gases, very high velocities must be used in order to effect any abrasive action, because high speed impingement of the grit particles against the surface to be abraded is the essential force in such processes. In the present invention, as in other abrasive flow machining processes, the medium is a semi-solid plastic, forced through the restriction under considerable pressure with a relatively low velocity. The semi-solid plastic medium must not only maintain the abrasive particles in a uniform suspension, but it must further provide a relatively firm backing for the abrasive grit to press the grit firmly against the passageway surfaces while the semi-solid medium and grit are extruded therethrough. Hence, rather than impinging at high speeds on the surface to be abraded, the grit is actively worked against the surface to be abraded.

The prior art apparatus to which this invention relates, consists of a frame member having two directly opposed media chambers secured thereto. The media chambers are plastic extruding, positive displacement, expandable chambers which can hydraulically or mechanically extrude abrading media therein through the passageway of the workpiece and then into the other media chamber. A removable workpiece fixture, designed to hold the workpiece, is secured between the two media chambers. The workpiece fixture must be designed to securely hold the workpiece such that the workpiece surface to be worked is exposed within the passageway between the two media chambers. If a surface to be abraded is merely a bore through the workpiece, the fixture must serve to merely seal each end of the bore to a media chamber so that the bore itself becomes a sealed passageway between one media chamber to the other. On the other hand, if the workpiece surface to be abraded is an external surface, the fixture is usually more complex and must be designed to define the essential restricted passageway adjacent to that surface so that the surface to be abraded forms a portion of the passageway and the medium will abrade that surface as it is extruded through the passageway.

The extruding medium, consisting of a semisolid, difficulty flowable plastic material permeated with a abrasive grit, is contained in one of the media chambers, while the other chamber is empty. To perform the process, the medium is then extruded, hydraulically or mechanically, from the filled chamber to the empty chamber via the restricted passageway through or past the workpiece surface to be abraded, thereby working the surface as desired. Typically, the extruding medium is then extruded back and forth between the chambers to the extent necessary to effect the degree of abrasion desired. Counterbores, recessed areas and even blind cavities can be abraded by using restrictors or mandrils to direct the medium flow along the surfaces to be abraded. A more detailed description of the prior art can be found in U.S. Pat. Nos. 3,521,412 and 3,634,973.

While the prior art techniques are very effective, they do have their limitations when multiple media paths are involved or when different surfaces require different treatments. As for multiple media paths having different cross-sectional areas, it should be obvious that the volume of flow will be the greatest through the larger passageway. Since there is less resistance to flow, the velocity will also be higher as compared to the more restricted passageway, and the comparative volume of flow passed will be greater than the comparative cross sectional areas of the passages. Hence more working or abrasion will occur in the larger, less restricted passageway. For example, any number of parallel restrictions can be processed in a single operation producing equal work in each restriction, provided cross-sectional areas of the passageways are equal or near equal. If there are two parallel restrictions in the same flow stream with significantly different cross-sectional areas, the more restricted passageway will be abraded to a lesser extent because it will pass less than a proportional volume of flow. These multiple layers of applications may require completely separate processing with multiple fixtures, each creating separate passageways. In this situation, the workpiece may have to be loaded and unloaded several times into different fixtures and processed within each fixture before all surfaces can be treated as desired.

Another area of use for abrasive flow machining that has its limitations is the processing of workpieces having multiple intersecting passage. One example is the polishing of the passages of a simple "T" joint. In accordance with the prior art, this would normally be done by extruding into one of the three passages and out the other two. If all three passages have the same cross sectional area, however, most of the working will be done in the single passage feeding the other two. Only by using multiple operations or restrictors could equal work be done on each passageway.

Still another example of the limitations of the prior art process for abrasive flow machining is in the deburring of a complex valve body with multiple main bores that are connected to one another by cross holes. Prior art abrasive flow machining would almost certainly require multiple set-ups to process all intersections to remove the burrs.

SUMMARY OF THE INVENTION

An object of this invention is to provide a process and apparatus for the abrasive flow machining of complex workpieces utilizing a fixture having at least three ports of ingress and egress of the plastic medium, and accordingly the abrasive flow machining apparatus for use therewith having at least three positive displacement chambers communicating with the ports of ingress and egress to thereby permit a single operation to abrade all surfaces as desired. Accordingly, this will provide a system having at least two feed chambers and/or at least two receiving chambers. In operation, the multiple feed chambers, and/or the multiple receiving chambers should operate in parallel and be independently regulated to effect differential abrading in the various passageways. This can be done by varying the feed rates and/or pressures of the multiple feed chambers and/or varying the back pressure of the multiple receiving chambers with the result that the degree and nature of abrasion in each of the separate passageways can be independently controlled to the extent desired. This will not only save considerable time and effort by eliminating the need for repeated loading and unloading of the workpiece into different fixtures, but it will further simplify the design effort when designing fixtures. That is to say, the use of multiple feed chambers, and/or multiple receiving chambers, will permit extrusion parameter adjustments, i.e. rates, pressures, back pressures etc. to vary the programming which will greatly simplify fixture designing. In the prior art, extrusion parameters were limited by the passageway geometry and dimensions. By variably programming the feed rates, feed pressure, receiver resistance and the like through multiple passageways, variable and complex flow patterns through and over the workpiece can be created. This not only provides greater latitude to the operation, but simplifies fixture requirements since the variable programming can perform variable functions which previously required separate specific fixtures, and exacting fixture tolerances. In addition, it is possible to terminate working in one portion of the workpiece while continuing in another. This will minimize overworking which is energy wasteful and may in fact be detrimental to the workpiece.

Accordingly, this invention will greatly minimize if not eliminate many of the limitations in the prior art as discussed above. In those applications of the prior art abrasive flow machining where multiple set-ups have been required, the utilization of this invention will certainly reduce the number of set-ups, and will in most applications permit the entire processing to be done in one fixturing set-up. The increased possibility for automation and resultant greater quality assurance by eliminating possibilities for operator error should be readily apparent.

DESCRIPTION OF THE INVENTION

Figure 1:
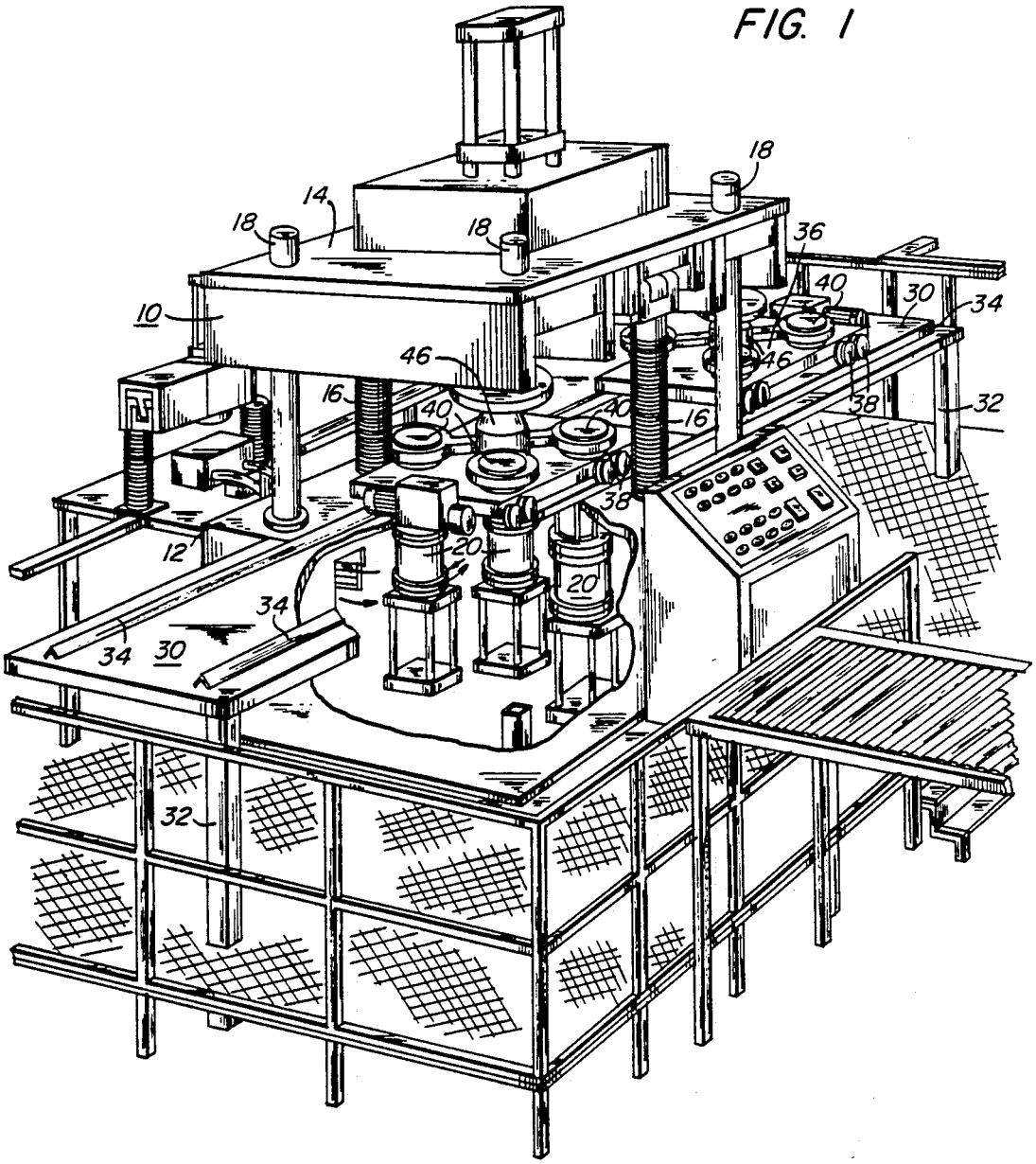
FIG. 1 is a partial cut-away, isometric view of one embodiment of this invention utilizing four feed chambers and one receiving chamber.
Figure 2:
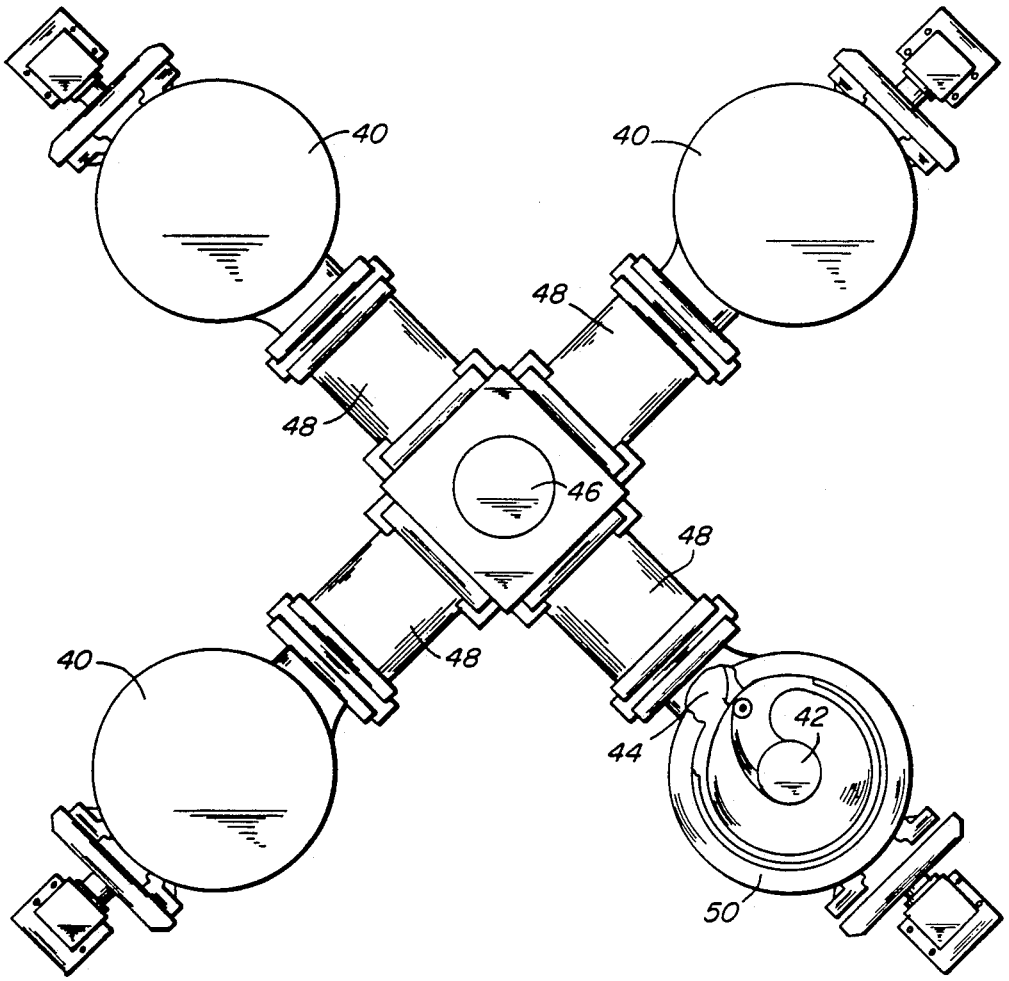
FIG. 2 is a plan view of the top of the carriage shown in FIG. 1, illustrating the arrangement of four manifolds and a fixture, with one manifold in cross section to illustrate the interior thereof.

The above described figures illustrate one embodiment of this invention utilizing four feed chambers and one receiving chamber. With reference to FIG. 1, this embodiment of the invention consists of a screw press 10 having a support bench 12, a press head 14, two screw drives 16 and four guide pins 18, such that the press head can be selectively raised or lowered with respect to support bench 12. Since such presses are well known in the art, no further description is necessary here, suffice it to say that any type of press, mechanical of hydraulic would be suitable. Below the upper surface of support bench 12 are four vertically disposed feed chambers 20 with their axes uniformly spaced from the center line of press head 14. Each feed chamber 20 is a positive displacement expandable chamber, and is secured to the under side of support bench 12 such that its contents can be extruded vertically upward through orifices (not shown) extending through support bench 12.

In the embodiment illustrated, two work tables 30 are positioned on opposing sides of support bench 12 each having one end secured to work table 12 with the other end supported by legs 32. Two equal lengths of steel angle bars 34 are secured in a parallel relationship to the top of support bench 12 and work tables 30, which in essence form tracks extending from one work table 30 to the other across the center of support bench 12. A carriage 36, having four wheels 38, rollably rests on the tracks formed by angle bars 34 so that said carriage 36 can be rolled from either work table 30 onto support bench 12. For optimum efficiency, two such carriages 36 should be provided.

Four inlet manifolds 40 are secured to the upper surface of carriage 36, each having a inlet orifice 42 extending therefrom downward through the upper surface of carriage 36. Manifolds 40 are spaced such that when carriage 36 is centered under press head 14, inlet orifices 42 are properly aligned with the openings (not shown) through support bench 12 communicating with feed chamber 20. Outlet orifices 44 from manifolds 40 each extend horizontally towards fixture 46 which is centrally disposed between the four manifolds 40. Extension pipes 48 may be necessary to couple outlet orifices 44 to the inlet openings (not show) in the side of fixture 46. The need for and length of any such extension pipes 48 will depend on the size and shape of fixtures 46. The size and design of fixture 46 will of course vary widely depending upon the workpiece or workpieces to be processed therein. The outlet orifice 48 from fixture 46 is provided through the top center surface.

A receiving chamber 52, is secured to the underside of press head 14 at the center line thereof. The inlet orifice (not shown) to receiving chamber 52 is provided through the center of the bottom surface thereof so that it will align with the outlet orifice 48 from fixture 46.

In operation, a suitable fixture 46 must be set up with the workpiece therein. While a carriage 36 is positioned on work table 30, the fixture is properly secured between manifolds 40, utilizing the necessary lengths of extension pipes 48 to couple each manifold outlet orifice 44 to the inlet orifice (not shown) into the fixture.

Once the fixture is properly mounted onto a carriage 36 and properly secured and sealed to manifold 40, the carriage 36, with the fixture 46 and manifolds 40 thereon, is rolled onto support bench 12 so that the manifold inlet orifices 42 are properly aligned with outlet orifices extending through support bench 12 from feed chambers 20. When carriage 36 is properly aligned in position, press head 14 is lowered so that receiving chamber 52 engages the upper surface of fixture 46 thereby aligning inlet orifices [not shown] on chambers 52 on outlet orifices 48 on fixture 46. Proper seals (not shown) must of course be utilized between the orifices through support table 12 and the orifices in manifolds 40, as well as between the the inlet orifice to the receiving chamber and the outlet orifice 48 from fixture 46, so that the media path is sealed when press head is forcibly lowered, tightly securing fixture 46 and manifolds 40 between press head 14 and support table 12.

When the system is properly positioned, and feed chambers 20 are properly charged with the working medium, the feed chambers 20 are activated to extrude the medium upwardly into manifolds 40, then through extension pipes 48 and into and through fixture 46 where the workpiece is abraded as desired by the medium. From fixture 46, the medium is extruded further into receiving chambers 52.

As is typical with prior art practices, some applications of this invention are readily amenable to two way extrusion. That is, when the feed chambers are empty and the receiving chamber or chambers full, the operation can be reversed so that the receiving chambers become the feed chambers extruding the medium back through the restricted passageway in the reverse direction and back into the feed chambers. In more complex operations with complex flow passageways, such a reverse extrusion may not always be practical. In this latter situation, a separate media return system will be necessary to avoid the need for manually exchanging the medium from the receiving chamber 52 to the feed chambers 20.

As shown in FIG. 1, there are two work tables 30 and two carriages 36. While only one each is necessary, the provision of two provides considerable expediency in that a worker can be setting-up one fixture 46 on one table 30 while another fixture on the other carriage is positioned in place with the extrusion process in progress. Then when one operation is completed, the one carriage can be rolled out onto one work table 30 for break down while the other carriage is rolled onto the support bench 12 from the other work table 30 for extrusion processing.

What is claimed is:

1. An apparatus for abrasive flow machining by controllably extruding a flowable plastic medium containing abrasive particles through a passageway, said passageway including workpiece surfaces to be abraded and having at least three ports for ingress or egress of said medium comprising:

A. at least three positive displacement chambers adapted to independently feed and receive said plastic medium, each of said chambers adapted to communicate with at least one port of said passageway;

B. a drive means associated with each of said positive displacement chambers to independently drive each of said positive displacement chambers to effect extrusion of said medium through said passageway and thereby effect abrasion on said workpiece surface;

C. control means to individually regulate each of said drive means to feed said medium from, and receive medium into said chambers, in response to the abrasion requirements of the said workpiece surfaces.

2. An apparatus according to claim 1 wherein said control means regulates said drive means to simultaneously feed said medium from and receive medium into said chambers.

3. An apparatus according to claim 1 wherein said control means regulates said drive means to sequentially feed said medium from and receive medium into said chambers.

4. An apparatus according to claim 1 wherein said flowable plastic medium containing abrasive particles is extruded through a plurality of passageways, each of said passageways having at least two ports for ingress or egress, and said control means causes differential abrasion in different passageways.

5. An apparatus according to claim 4 wherein said control means achieves differential abrasion via sequentially extruding the medium through different passageways.

6. An apparatus according to claim 1 wherein said passageway has a plurality of intersecting segments and said control means causes differential abrading in different segments.

7. An apparatus according to claim 6 wherein said control means achieves differential abrasion via sequentially extruding the medium through different segments.

8. An apparatus according to claim 1 wherein said control means achieves differential abrasion via differential displacement of a least two feed chambers at the same time.

9. An apparatus according to claim 1 wherein said control means achieves differential abrasion via differential back pressure on at least two receiving chambers at the same time.

10. An apparatus according to claim 1 wherein said control means achieves differential abrasion via differential extrusion pressure on at least two feed chambers at the same time.

11. An apparatus according to claim 1 wherein said control means achieves differential abrasion via differential displacement of at least two feed chambers and differential back pressure on at least two receiving chambers all at the same time.

12. An apparatus according to claim 1 wherein said control means achieves differential abrasion via differential extrusion pressure of at least two feed chambers and differential back pressure on at least two receiving chambers all at the same time.

13. An apparatus according to claim 1 wherein said control means achieves differential abrasion via differential extrusion pressure of at least two feed chambers, differential displacement of at least two feed chambers and differential back pressure on at least two receiving chambers all at the same time.

14. An apparatus according to claim 1 wherein said control means achieves reciprocal operation by changing the direction of medium flow by converting at least one receiving chamber to a feed chamber and at least one feed chamber to a receiving chamber so that said medium is at least in part extruded back through said passageway to at least one original feed chamber.

15. An apparatus according to claim 1 wherein said control means achieves reciprocal operation by changing one receiving chamber into a refeed chamber which will extrude the medium back to the original feed chambers.

16. An apparatus according to claim 1 wherein said control means achieves reciprocal operation whereby the receiving chambers are activated to extrude the medium back to the original feed chambers via a bypass conduit system.

17. An apparatus for abrasive flow machining by controllably extruding a flowable plastic medium containing abrasive particles through a passageway, said passageway having at least three ports for ingress and egress of said medium, a plurality of intersecting segments and including workpiece surfaces to be abraded comprising:

A. at least three positive displacement chambers adapted to independently feed and receive said plastic medium, each of said chambers adapted to communicate with at least one port of said passageway, B. a drive means associated with each of said positive displacement chambers to effect extrusion of said medium through said passageway, C. control means to individually regulate each of said drive means to selectively and differentially feed said medium from, and receive medium into said chambers to cause differential machining in different segments.

18. An apparatus according to claim 15 having a plurality of passageways, each of said passageways having at least two ports for ingress or egress for said medium and having at least four of said positive displacement chambers whereby said control means causes differential machining in different passageways.

* * * * *